US007071876B2

(12) United States Patent
Reynet et al.

(10) Patent No.: US 7,071,876 B2
(45) Date of Patent: Jul. 4, 2006

(54) HIGH IMPEDANCE SUBSTRATE

(75) Inventors: Olivier Reynet, Chambray les Tours (FR); Olivier Acher, Monts (FR); Marc Ledieu, Ballan-Mire (FR)

(73) Assignee: Commissariat A l'Energie Atomique, Paris (FR)

( * ) Notice: Subject to any disclaimer, the term of this patent is extended or adjusted under 35 U.S.C. 154(b) by 0 days.

(21) Appl. No.: 10/538,476

(22) PCT Filed: Aug. 30, 2004

(86) PCT No.: PCT/FR2004/050398

§ 371 (c)(1),
(2), (4) Date: Jun. 7, 2005

(87) PCT Pub. No.: WO2005/024999

PCT Pub. Date: Mar. 17, 2005

(65) Prior Publication Data

US 2006/0044209 A1 Mar. 2, 2006

(30) Foreign Application Priority Data

Sep. 2, 2003 (FR) ..... 03 50492

(51) Int. Cl.
*H01Q 1/38* (2006.01)

(52) U.S. Cl. ..... 343/700 MS; 343/895

(58) Field of Classification Search ..... 343/700 MS, 343/846, 895

See application file for complete search history.

(56) References Cited

U.S. PATENT DOCUMENTS

| | | | | |
|---|---|---|---|---|
| 5,561,438 | A | 10/1996 | Nakazawa et al. | 343/787 |
| 6,384,797 | B1 * | 5/2002 | Schaffner et al. | 343/795 |
| 2003/0048234 | A1 | 3/2003 | Alexopoulos et al. | 343/895 |
| 2004/0263420 | A1 * | 12/2004 | Werner et al. | 343/909 |
| 2005/0030137 | A1 * | 2/2005 | McKinzie et al. | 335/306 |

FOREIGN PATENT DOCUMENTS

| | | |
|---|---|---|
| EP | 1 195 847 | 4/2002 |
| JP | 58-137206 | 8/1983 |
| WO | 02/071544 | 9/2002 |

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

A high-impedance substrate including a first layer made of insulating material, having a lower face and an upper face, the substrate including conductor patterns mechanically linked to the substrate. Some of the conductor patterns mechanically linked to the substrate are associated with a magnetic tile. At least one electrical interconnection puts two points distinct from one another of a conductor pattern mechanically linked to the substrate in electrical contact, this conductor pattern having an assigned magnetic tile, passing above the magnetic tile associated with the conductor pattern mechanically linked to the substrate.

23 Claims, 5 Drawing Sheets

Figure 1:
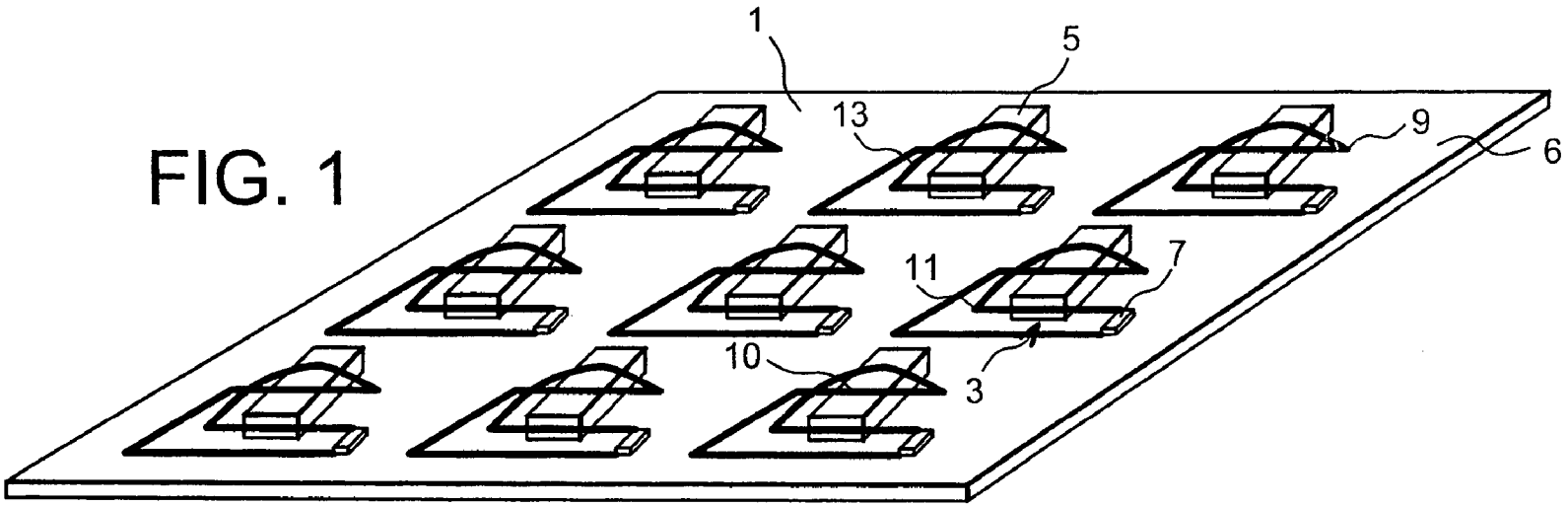

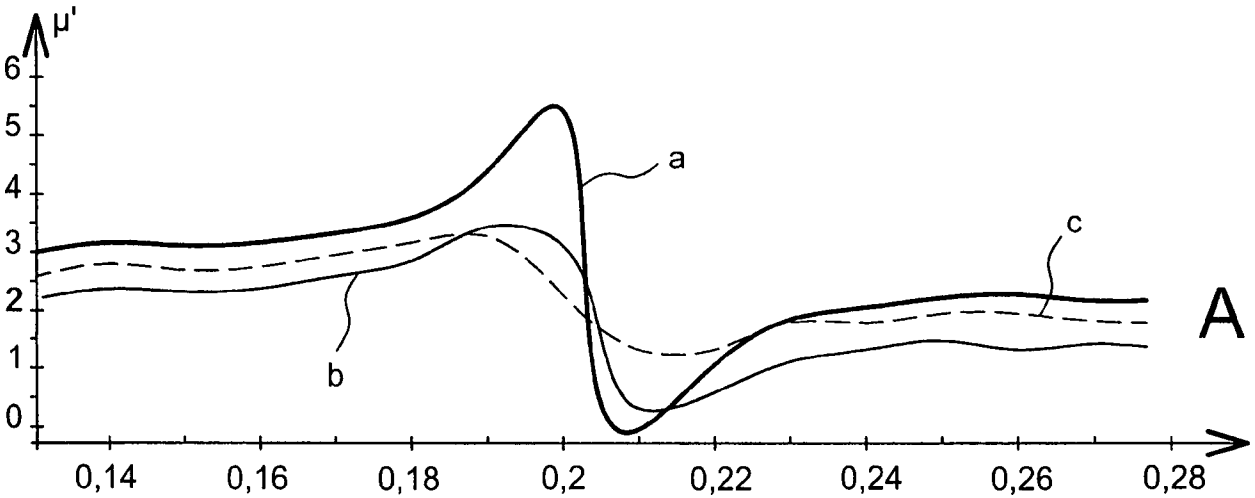
FIG. 3
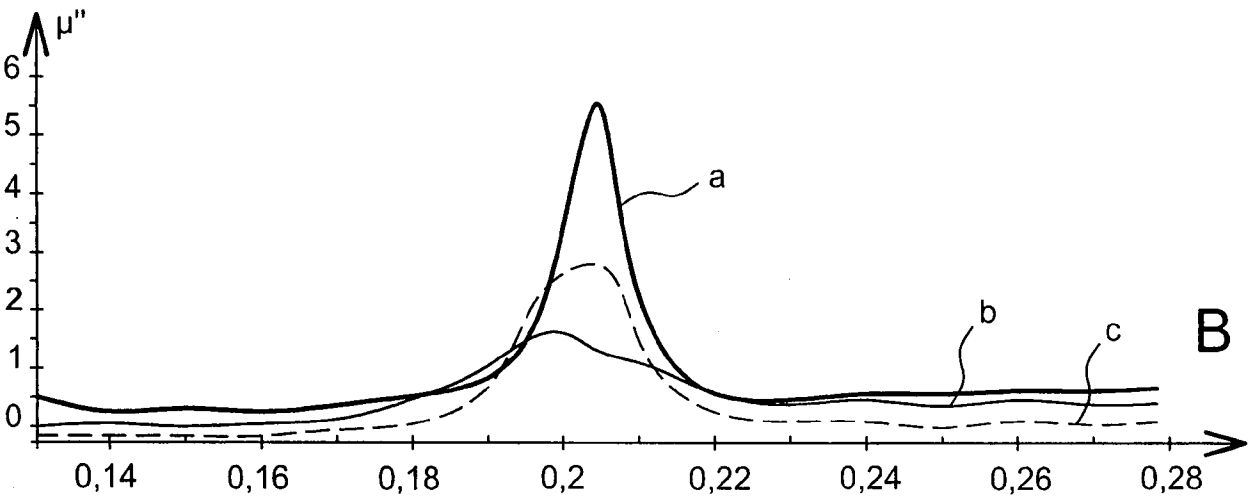

HIGH IMPEDANCE SUBSTRATE

This application is a 371 of PCT/FR04/50398 filed Aug. 30, 2004.

TECHNICAL FIELD

The invention relates to the field of high-impedance substrates. Such substrates are, in particular, applied in hyper frequency devices. The invention finds application especially though not only in telecommunications, for example in the frequency band ranging from around 50 MHz to around 4 GHz for creating antennae.

PRIOR ART

Patent application EP 1 195 847 A2 published in April 2002 discloses different known embodiments of high-impedance substrates in relation to the prior art cited in said application.

Said application describes for example in relation to FIGS. 9 and 10 an artificial magnetic conductor 900 constituting a high-impedance surface including:

a surface selective in frequency having a permeability dependent on the frequency in a normal direction to the surface selective in frequency a conductive earth plane 806 parallel to the surface selective in frequency and a dielectric medium between the earth plane and the surface selective in frequency in which conductive metallic parts in the form of partitions perpendicular to the earth plane link the surface selective in frequency to the earth plane.

The surface is selective in frequency since it comprises a network 102 of resonant loops also known as artificial magnetic molecules 804.

These resonant loops or artificial magnetic molecules 804 are strongly interconnected in a capacitive manner, thus forming a capacitive surface selective in frequency.

Different embodiments, especially including multi-band surfaces constituted by layers respectively comprising resonant loops with different frequencies, and uses of such a surface are described, in particular for producing antennae.

It is known that such high-impedance substrates are very useful in the field of antennae. Such surfaces are provided to interact with an incident electromagnetic wave arriving at this high-impedance surface. They decrease the size of the devices used while improving the characteristics of selectivity and directivity of the resulting antennae.

SHORT DESCRIPTION OF THE INVENTION

The aim of the invention is a high-impedance surface having a weak thickness in comparison with the wave length in vacuum at a central frequency of a wave of a frequency band for which the surface has high-impedance. The aim is also a high-impedance surface having a large bandwidth. Another aim is a high-impedance surface using magnetic materials not limited by the properties of the material to the work frequencies of the surface.

An aim is a tuneable high-impedance surface, that is, whereof the central frequency and bandwidth be made to vary on command.

For all these aims the invention is relative to a high-impedance substrate comprising a first layer or sheet made of an insulating material, having a lower face and an upper face, the substrate comprising conductor patterns mechanically linked to the substrate, characterised in that some of the conductor patterns mechanically linked to the substrate are associated with a magnetic tile, and in that at least one electric interconnection puts two distinct points of a conductor pattern mechanically linked to the substrate, in electrical contact with one another, said conductor pattern having an associated magnetic tile, said electric interconnection passing above the magnetic tile associated with said conductor pattern mechanically linked to the substrate.

The term tile indicates all the points of a metric space whereof each of the coordinates is taken in a restricted interval and whereof the rectangular parallelepiped is the simplest image. This is a small piece of material.

In an embodiment, conductor patterns are constituted by conductive tracks deposited on one and/or the other of the upper or lower faces of the first layer or sheet made of insulating material.

In another embodiment, the high-impedance substrate comprises, apart from a first layer or sheet made of insulating material, a second layer or sheet having an upper face opposite the lower face of the first sheet or layer and a lower face, the conductor patterns being deposited at least partly between them, on one and/or the other of the upper or lower faces of this second layer or sheet.

In an embodiment the conductor patterns form electrical circuits optionally together with active or passive components. Preferably when the high-impedance substrate comprises a second layer or sheet these active or passive components are surface-mounted on one and/or the other of the upper or lower faces of said second layer or sheet.

In an embodiment the electronic components are elements having a resistance value and capacity value.

In an embodiment the high-impedance substrate further comprises an earth plane, constituted by a third layer or sheet having an upper face and a lower face, with one at least of these faces being constituted by a conductive material.

This earth plane can be situated above the upper face of the first layer or sheet and in this case the magnetic tiles will be mechanically linked to the upper face of this earth plane.

The earth plane can also be under the first sheet or layer, or if the embodiment comprises a second sheet or layer between the first sheet or layer and the second sheet or layer, or even under the second sheet or layer. In these latter cases the magnetic tiles will be mechanically linked to the upper face of the first sheet or layer.

BRIEF DESCRIPTION OF THE DIAGRAMS

Figure 2:
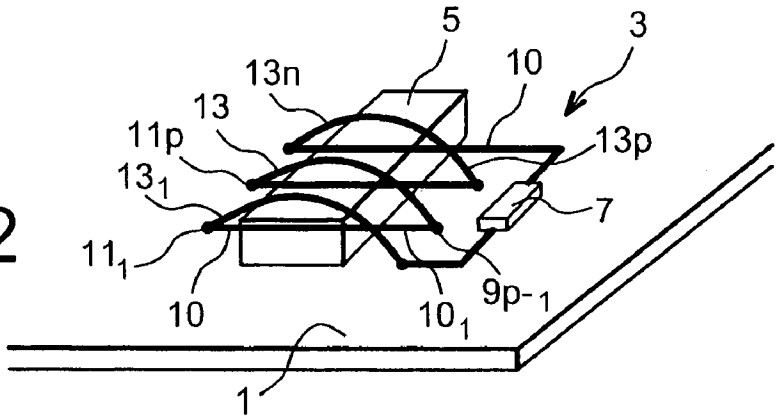

Embodiments of the invention and other advantages of the invention will now be described in reference to the attached diagrams, in which:

FIG. 1 is a perspective view of a first embodiment of the invention,

FIG. 2 shows an exemplary embodiment of a conductor pattern constituting a solenoid along with the connections passing above the magnetic tile, FIG. 3 comprises parts A and B, which are curves representing respectively, as a function of the work frequency expressed in gigahertz, for a high-impedance substrate according to the invention, the real values of the magnetic permeability u', in part A and the values of magnetic losses u" in part B for different resistance values.

Figure 4:
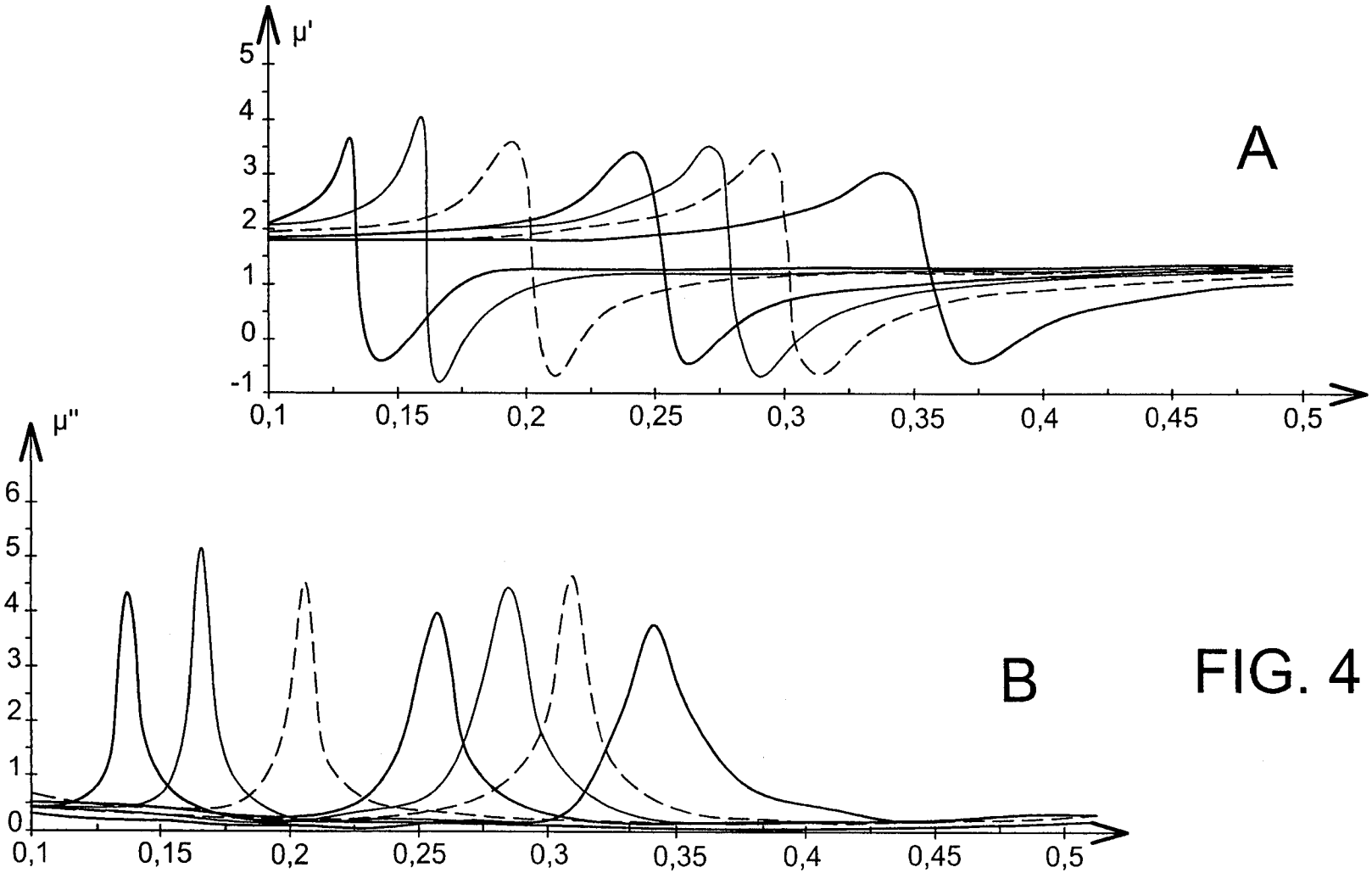
Figure 5:
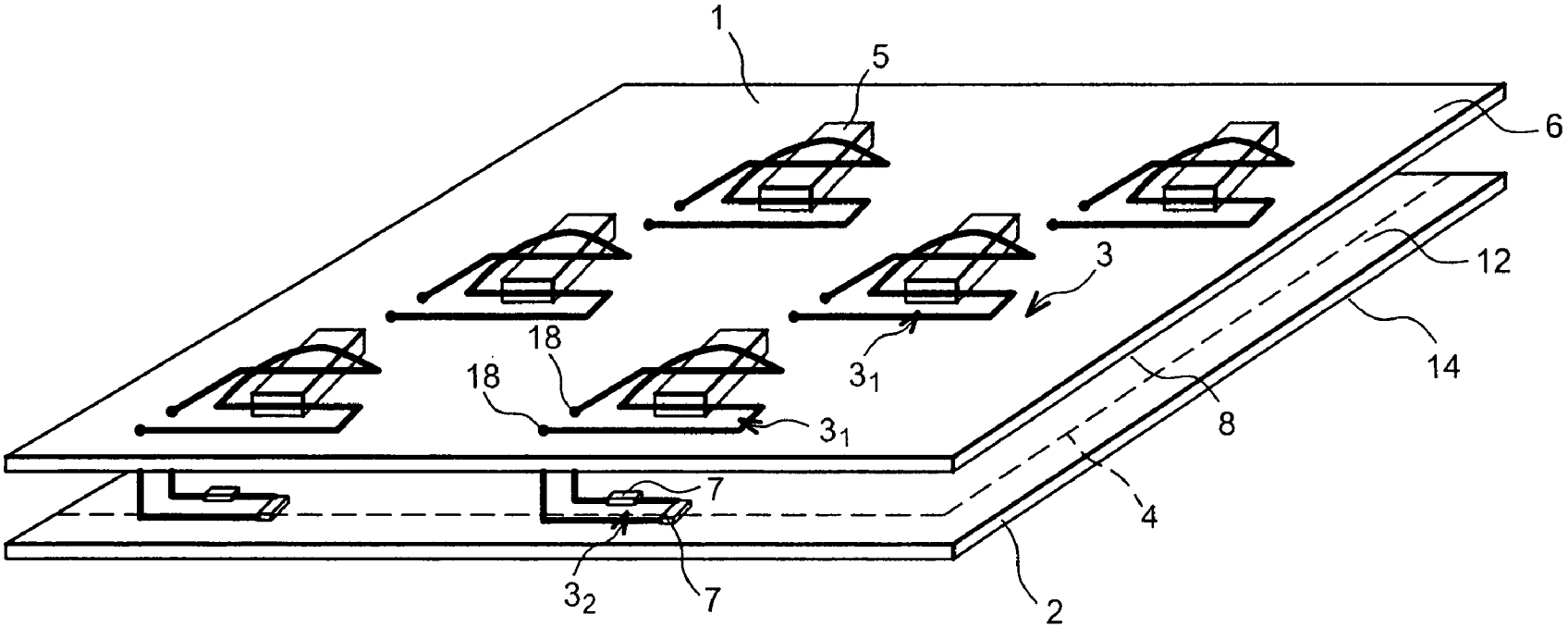
Figure 6:
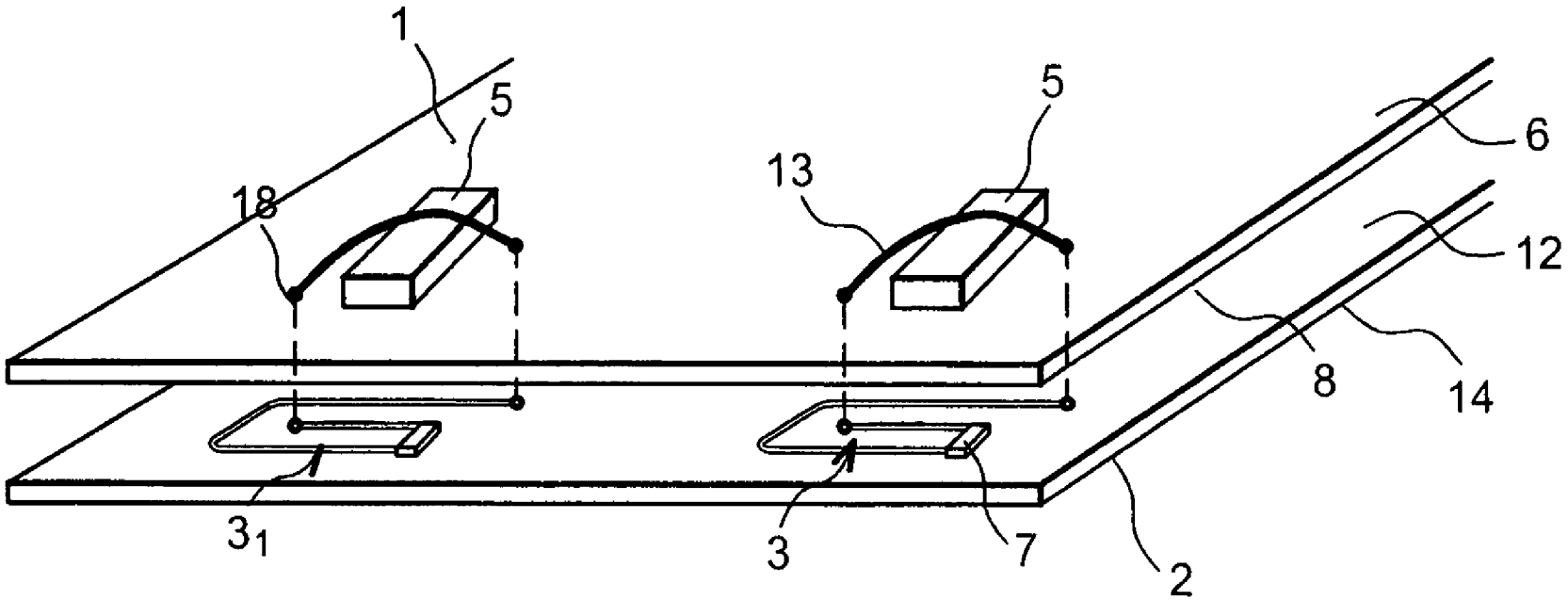

FIG. 4 comprises parts A and B. These are curves representing respectively, as a function of the work frequency expressed in gigahertz, for a high-impedance substrate according to the invention, the values of the magnetic permeability u', in part A and the values of magnetic losses u" in part B for different capacity values, FIG. 5 is a perspective view of a second embodiment of the invention, FIG. 6 is a perspective view of a third embodiment of the invention.

In all the diagrams the same reference numerals designate similar elements having the same function, such that the description of an element already commented on in one figure will not necessarily be repeated in figures described thereafter.

DETAILED DESCRIPTION OF PARTICULAR EMBODIMENTS

FIG. 1 is a perspective view of a first embodiment of the invention.

Arranged on an upper face 6 of a plate made of insulating material 1, Kapton® for example, is a plurality of electrically conductive patterns 3. A tile 5 made of magnetic material is associated with each of the conductor patterns 3. In the embodiment illustrated in FIGS. 1, 5 and 6, each tile 5 has the form of a parallelepiped, rectangular for example. Each electrically conductive pattern 3 forms, together with active and/or passive components, an electrical circuit, overall illustrated by a rectangle 7 in FIG. 1. According to the invention, this circuit is completed by an electrical interconnection, for example in the form of a wire or a ribbon 13, connecting a first 9 and a second 11 point distinct from the first, of the pattern 3. A part of the pattern 3, and the wire or ribbon of connection 13, thus combine to form a turn enclosing the magnetic tile 5. In the general case, there will be several turns enclosing the magnetic tile 5.

A pattern example 3, enabling a configuration with several turns together forming a solenoid surrounding the magnetic tile 5 has been illustrated in perspective in FIG. 2. The pattern 5 comprises several conductive tracks 10, parallel to each other, and for example perpendicular to the direction of greatest length of the parallelepipedic tile 5.

The tracks 10 each have two ends 9 and 11. There are n tracks each having a first end $\mathbf{9}_0$ to $\mathbf{9}_{n-1}$ and a second end $\mathbf{11}_1$ to $\mathbf{11}_n$. There are n wires or ribbons $\mathbf{13}_1$ to $\mathbf{13}_n$, each wire or ribbon of rank connection p linking a first end $\mathbf{9}p_{-1}$ to a second end $\mathbf{11}_p$. n and p are whole numbers, and p is less than or equal to n. In the interests of simplifying FIG. 2, references $\mathbf{9}_0$, $\mathbf{9}_{n-1}$ do not appear.

The turns formed by one part of the conductor pattern 3 and the connections 13 are inserted in series or in parallel with other parts of the conductor pattern 3.

A high-impedance substrate incorporating the invention has been produced according to the embodiment described in relation to FIGS. 1 and 2. A plate made of Kapton® 1 having a surface of 500×500 $mm^2$, initially copper-plated on its upper face 6 was used. The conductor patterns 3 were made by etching techniques on the conductive copper layer, known per se in the field of printed circuits. These patterns in the form of tracks have a width of around 1 mm. A capacity and resistance were provided at the placements marked 7 in FIG. 1. In an exemplary embodiment the capacity was 21 Pico farads and the resistance 0.1 ohms. It is likewise possible to add to a capacity or resistance of fixed value, or to replace such capacity or such resistance by one or more active components having a variable capacity and/or resistance value, for example controlled electronically. As a general rule the capacity value of the component is a function of an electrical variable, voltage or current, applied to said active component. The varactor ZC830B manufactured by Zetex, which enables the capacity of the RC circuit 7 to be varied simply, could be used, for example. In this case, as will be explained here below in connection with FIG. 5, an earth plane is interposed preferably between the tiles 5 and the conductor patterns 3, the latter in this case being partially or fully plotted on a second sheet or layer 2 placed under the layer 1.

A magnetic layer constituted for example by an elastomer loaded 50% with iron powder is placed above the conductor patterns 5, for example stuck by means of an insulating adhesive. This material has a magnetic permeability μ' of 11 and low magnetic losses u", less than the unit. It is noted that the magnetic losses correspond to the imaginary value of the magnetic permeability.

It would have likewise been possible to use rubber or a plastic material loaded with a magnetic powder as material, without the examples cited below constituting an exhaustive list. Preferably, the volume fraction of magnetic powder exceeds 30%. It is likewise possible to use stacks of magnetic and insulating layers, comprising at least 5% by volume of magnetic material. The conductive direction of the stacks will preferably be parallel to the axis of the solenoid formed by the connections 13 and their complement of the pattern 3.

The layer of magnetic material is etched in two directions of the plane of the layer, for example, perpendicular, at a depth of 5 mm for example, so as to obtain the magnetic tiles 5. In the examples having been used for measurements, to be explained below, the tiles 5 measured 5×3×30 mm. Considering the spacing between the tiles, the surface fraction occupied by the tiles is around 10%. Then n conductive wires 13 are plotted, for example n=5 passing above each tile 5, so as to form with each pattern 3 a solenoid having 5 turns surrounding the tile 5 associated with this pattern. As a general rule the solenoid will comprise between one and 50 turns. The solenoid in this example is in series with the RC circuit, formed by the resistance and capacity illustrated symbolically by the square 7 in FIG. 1.

The advantage of introducing a magnetic material forming a core in the solenoid thus formed is to significantly increase the levels of magnetic permeability relative to the case "without core".

The applicant has performed measurements of magnetic permeability and magnetic losses obtained with magnetic tiles 5 made of elastomer material loaded with 50% iron powder realised as indicated hereinabove for three values 0.1, 2, and 10 ohms of resistance R of the RC circuit. The capacity C during these measurements has remained at a value of 50 Pico farads. The solenoid surrounding each tile 5 comprised 5 turns.

The characteristics of magnetic permeability obtained as a function of the work frequency are illustrated by curves illustrated in FIG. 3 part A and B.

The values of magnetic permeability μ' are illustrated in part A of FIG. 3. Part B represents the values of the magnetic losses μ" as a function of the frequency expressed in gigahertz. The peak values of μ" decrease when the value of the resistance grows. The highest peak has a level of 5 and the narrowest is obtained for the resistance value 0.1. The curve corresponding to this resistance value is referenced a. The two other curves, referenced c and b respectively have peaks whereof the height decreases and the width increases with the growth of the value of resistance respectively for values of resistance passing from 2 to 10 ohms. In the example in question, the width of the peak of magnetic losses passes from 10 MHz for the resistance value 0.1 ohms to 35 MHz for the resistance value 10 ohms. The levels of μ' and μ" are the essential values which condition the impedance viewed by an electromagnetic wave arriving on the high-impedance substrate thus obtained. The source of said wave is on the side of the face 6 of the plate 1 on which the magnetic tiles 5 are located. High levels of magnetic permeability favour the high impedances over a large frequency range.

Finally, the respective values of μ' and μ" condition the level of loss associated with the frequency, these losses being wanted or not according to the applications given to the high-impedance substrate. With the device according to the invention, the height of the peak of magnetic losses can be regulated or modified very easily by simple variation of a resistance value.

According to the invention it is likewise possible to regulate the levels of permeability and magnetic losses by increasing the density of cover of the face 6, by the magnetic tiles 5. For example, the levels illustrated in FIG. 3 correspond to a cover rate of 10% as explained hereinabove. Passage to a cover rate of 50% would increase the value of μ" by a factor of 5. So to obtain high levels of magnetic losses μ" the cover rates of the face 6 by the magnetic tiles 5 will be greater than 10%, for example 50% or preferably greater than 50%. By comparison, making a high-impedance substrate having the same impedances as those resulting from the values of μ' and illustrated in FIG. 3, by means of materials would require making available three materials each having hyper frequency characteristics, which can be a long and costly process with an uncertain result. According to the invention it suffices to correctly adjust the value of resistance of the RC circuit 7. It is thus possible to pass from a state of strong magnetic permeability μ', at 200 MHz for example, favourable for high-impedance, to a state of low permeability, which decreases impedance. Using an electronic circuit having a resistance as a function of a value of electrical magnitude of control of the circuit it is likewise possible to control the height of the peak of magnetic losses μ".

The applicant has likewise taken measurements of magnetic permeability and magnetic losses obtained with the magnetic tiles made of elastomer material loaded with 50% iron powder made as mentioned above for seven values, 38, 32, 21, 9, 5, 2, and 1 Pico farad of the capacity of the RC circuit. During these measurements the resistance R has remained at a value of 0.1 ohm.

The seven curves illustrated in part A of FIG. 4 each represent, the value of magnetic permeability μ' for the different values of the capacity C.

The value of losses μ" as a function of the frequency in gigahertz in abscissa is illustrated in part B of FIG. 4. The frequency corresponding to the loss peak decreases when the value of the capacity C grows. In this way a loss peak is present for a value of around 0.13 gigahertz on the curve corresponding to a capacity value of 38 Pico farads. For the capacity value of 1 Pico farad, the loss peak is present for a value corresponding to around 0.37 gigahertz. The loss peaks of the 5 other curves are graduated at intermediate values between these two frequency values. These peaks are located at frequency values which grow when the value of the capacity C decreases from the value 32 pF to the value 2 pF.

These curves illustrate that according to the invention, adding or selecting several simple electronic components results in a high-impedance surface whereof the response in frequency presents a peak of magnetic losses which reaches values of several units, and this from a lesser quantity of magnetic tiles each fitted with its assigned solenoid. The frequency of the loss peak can be adjusted simply by regulating the value of a capacity. With a capacity which can be controlled electronically, by variation of an electrical control variable, the result can be an agility in frequency and possibly rapid variation, the frequency for which the loss peak μ" is the highest, and thus for which the impedance seen by the incident electromagnetic wave is the highest. Such circuits are known in the prior art and will not be further detailed here.

Another embodiment will now be explained in connection with FIG. 5. In this embodiment, a part at least or all of the conductor pattern 3 is placed on a second sheet or layer 2. This second sheet or layer 2 has two faces, an upper face 12 opposite the lower face 8 of the first sheet or layer 1 and a lower face 14. The upper face 12 of the sheet or layer 2 receives part $\mathbf{3}_2$ of the conductor pattern 3. The part $\mathbf{3}_2$ of the conductor pattern 3 preferably comprises all the active or passive components 7 forming a circuit with the conductor pattern 3. Optionally a part $\mathbf{3}_1$ of the conductor pattern 3 remains on the upper face 6 of the first sheet or layer 1, as illustrated in FIG. 5. The same applies for the magnetic tiles 5 which are linked mechanically, for example stuck, on the upper face 6 of the first layer or sheet 1. In a well-known manner the electrical connections between the conductor pattern part $\mathbf{3}_1$ and the conductor pattern part $\mathbf{3}_2$ are ensured by plated-through holes 18 joining the upper and lower faces of the layer or sheet 1. In particular the connections between the connections 13 passing above a magnetic tile 5 and the conductor pattern part 3 located on the sheet or layer 2 are ensured by such plated-through holes 18, when the conductor pattern part $\mathbf{3}_2$ comprises complement to said connections 13 to form a solenoid. In the embodiment illustrated in FIG. 5, the lower face of the sheet or layer 2 is plated such that this sheet or layer 2 forms an earth plane. Therefore in this embodiment the substrate according to the invention comprises an earth plane located below the first layer or sheet 1 opposite the lower face of said first layer or sheet.

In alternative embodiments of this embodiment, intended to reduce, upwards, the electromagnetic leaks produced by currents circulating in the pattern part $\mathbf{3}_2$, a conductor plan 4 forming an earth plane is interposed between the sheets or layers 1 and 2. The plan conductor can be in the form of for example a third layer or sheet 4. In FIG. 5, so as not to spoil the appearance of the layer 2, this plan has been illustrated partially only. This third sheet or layer 4 thus comprises plated-through holes 18 each forming a connection passage. The outlet of these holes is, as known per se, insulated electrically to avoid earthing the connections.

A different form of the embodiment illustrated in FIG. 5, also enabling electromagnetic leaks upwards to be reduced, is illustrated in FIG. 6. In this variant embodiment the upper face of the sheet or layer 1 is entirely plated, with the exception of the placements surrounding the plated-through holes 18 electrically joining points of the sheet or layer 1 and points of the sheet or layer 2. The metallic tiles 5 are then stuck above the metallic deposit by means of an electrically insulating adhesive. With the exception of the plated-through holes 18 and their outlets the whole conductor pattern 3 is plotted on the second sheet or layer 2.

The invention claimed is:

1. A high-impedance substrate comprising:

a first layer or sheet made of insulating material, having a first face and a second face in a form of a lower face and an upper face; and conductor patterns mechanically linked to the substrate, wherein at least some of the conductor patterns mechanically linked to the substrate are associated with a magnetic tile placed on or above one of the first and second faces of the substrate, and at least one electrical interconnection puts two points in electrical contact distinct from one another of one of the conductor patterns mechanically linked to the substrate, this conductor pattern having an assigned magnetic tile, passing above the magnetic tile associated with the conductor pattern mechanically linked to the substrate.

2. The high-impedance substrate as claimed in claim 1, wherein the conductor patterns are constituted by conductive tracks deposited on at least one of the upper or lower faces of the substrate.

3. The high-impedance substrate as claimed in claim 1, wherein the conductor patterns are constituted by conductive tracks deposited on at least one of the upper or lower faces of the substrate and together forming an electrical circuit with electronic components.

4. The high-impedance substrate as claimed in claim 3, wherein the electronic components are elements having a resistance value and a capacity value.

5. The high-impedance substrate as claimed in claim 4, wherein the electronic components comprise one or more active elements having a capacity value that can vary as a function of a value of an electrical variable applied to the one or more active elements.

6. The high-impedance substrate as claimed in claim 1, further comprising a second layer or sheet having an upper face opposite the lower face of the first layer or sheet, and a lower face, and wherein a part at least of each of the conductor patterns is mechanically linked to at least one of the upper and lower faces of the second sheet or layer.

7. The high-impedance substrate as claimed in claim 1, further comprising a second layer or sheet having an upper face opposite the lower face of the first layer or sheet, and a lower face, and wherein all of the conductor patterns are mechanically linked to at least one of the upper and lower faces of the second sheet or layer.

8. The high-impedance substrate as claimed in claim 3, further comprising a second layer or sheet having an upper face opposite the lower face of the first layer or sheet, and a lower face, and all of the conductor patterns and all of the electronic components forming an electrical circuit with the conductor patterns are mechanically linked to at least one of the upper and lower faces of the second sheet or layer.

9. The high-impedance substrate as claimed in claim 1, further comprising a ground plane situated underneath the first layer or sheet opposite the lower face of the first layer or sheet.

10. The high-impedance substrate as claimed in claim 6, further comprising a ground plane situated underneath the second layer or sheet opposite the lower face of the second layer or sheet.

11. The high-impedance substrate as claimed in claim 6, further comprising a ground plane situated between the first and second layers or sheets opposite the lower face of the first layer or sheet.

12. The high-impedance substrate as claimed in claim 9, wherein the ground plane is constituted by plating of the lower face of the first layer or sheet.

13. The high-impedance substrate as claimed in claim 10, wherein the ground plane is constituted by plating of the lower face of the second layer or sheet.

14. The high-impedance substrate as claimed in claim 1, further comprising a ground plane situated above the first layer or sheet opposite the upper face of the first layer or sheet.

15. The high-impedance substrate as claimed in claim 14, wherein the ground plane is constituted by a metallization of the upper face of the first layer or sheet.

16. The high-impedance substrate as claimed in claim 1, wherein the magnetic tiles are mechanically linked to the upper face of the first layer or sheet.

17. The high-impedance substrate as claimed in claim 1, comprising a plurality of electrical interconnections each putting two distinct points in electrical contact with one or the other of the conductor pattern mechanically linked to the substrate passing above the magnetic tile associated with the conductor pattern, the conductor pattern and the interconnections together forming a solenoid around the magnetic tile.

18. The high-impedance substrate as claimed in claim 6, wherein the conductor patterns with which a magnetic tile is associated each comprise a plurality of electrical interconnections each putting two distinct points in contact electrical with one another of the conductor pattern mechanically linked to the substrate passing above the magnetic tile associated with the conductor pattern, a first part of the conductor pattern and the interconnections together forming a solenoid around the magnetic tile, a second part of the pattern forming with capacitive and or resistive elements a circuit connecting the capacitive and/or resistive elements in parallel or in series on the solenoid.

19. The high-impedance substrate as claimed in claim 1, wherein the magnetic tiles comprise rubber or plastic material loaded with a magnetic material powder.

20. The high-impedance substrate as claimed in claim 19, wherein volume fraction of magnetic material powder of the rubber or of the plastic material forming the magnetic tiles is greater than 30%.

21. The high-impedance substrate as claimed in claim 1, wherein the magnetic tiles comprise a material constituted by a stack of magnetic and insulating layers.

22. The high-impedance substrate as claimed in claim 1, wherein a cover rate of a face carrying the magnetic tiles per the magnetic tiles is greater than 10%.

23. The high-impedance substrate as claimed in claim 1, wherein a cover rate of a face carrying the magnetic tiles per the magnetic tiles is greater than 50%.

* * * * *